US007704217B2

(12) United States Patent
Morrison

(10) Patent No.: US 7,704,217 B2
(45) Date of Patent: Apr. 27, 2010

(54) INFLATION AND DEFLATION OF AN ENCASED BLADDER SYSTEM

(76) Inventor: Corina Morrison, 75819 Camino Cielo, Indian Wells, CA (US) 92210

( * ) Notice: Subject to any disclaimer, the term of this patent is extended or adjusted under 35 U.S.C. 154(b) by 952 days.

(21) Appl. No.: 11/431,460

(22) Filed: May 10, 2006

(65) Prior Publication Data

US 2007/0273188 A1 Nov. 29, 2007

(51) Int. Cl.
*A61H 7/00* (2006.01)

(52) U.S. Cl. ..... 601/150; 601/148

(58) Field of Classification Search ..... 601/148–150, 601/55–57

See application file for complete search history.

(56) References Cited

U.S. PATENT DOCUMENTS 4,840,425 A * 6/1989 Noble ..... 297/284.1
4,986,260 A * 1/1991 Iams et al. ..... 601/43
5,022,385 A * 6/1991 Harza ..... 601/149
6,203,105 B1 * 3/2001 Rhodes, Jr. ..... 297/284.6
6,212,719 B1 * 4/2001 Thomas et al. ..... 5/713
2004/0097854 A1 * 5/2004 Hester et al. ..... 601/149
2006/0217645 A1 * 9/2006 Lockamy ..... 601/148

* cited by examiner

*Primary Examiner*—Steven O Douglas
(74) *Attorney, Agent, or Firm*—Banner & Witcoff, Ltd

(57) ABSTRACT

The present invention provides seating apparatuses that may reduce an effect of an ailment such as sciatica, joint illness, degenerative disc condition, hip bursitis, tendinitis, or sacral/coccyx pain. A seating apparatus includes a back portion and a seating portion, each portion having at least one encased bladder that is inflated by a pumping component in a timed sequence. The bladders may be differently shaped, asymmetrically situated with respect to a center axis, and spatially overlapping. The bladders are inflated and deflated in accordance with a predetermined time sequence and are independently controlled. The seating apparatus may contain a set of encased bladders that may be configured for different ailments. A user selects a treatment for one of the ailments through a remote control unit. Consequently, a subset of bladders is configured so that the selected subset of bladders is inflated and deflated.

6 Claims, 7 Drawing Sheets

(TREATMENT OF SCIATICA)
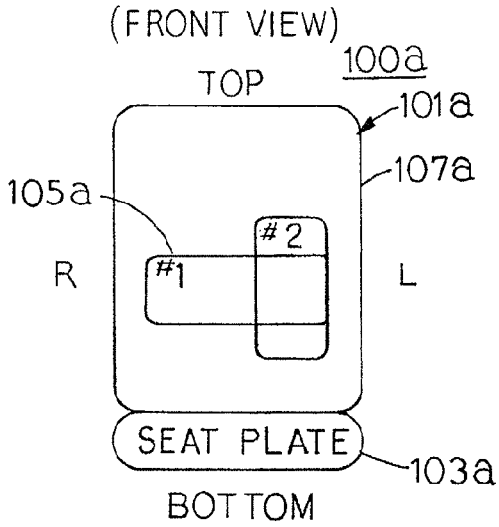
FIG.1A
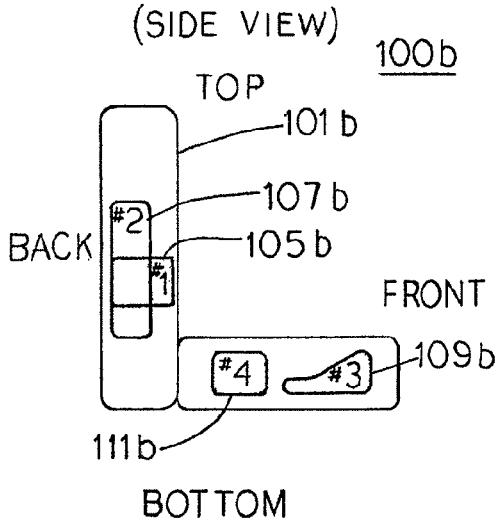
FIG.1B
(TREATMENT OF SCIATICA)
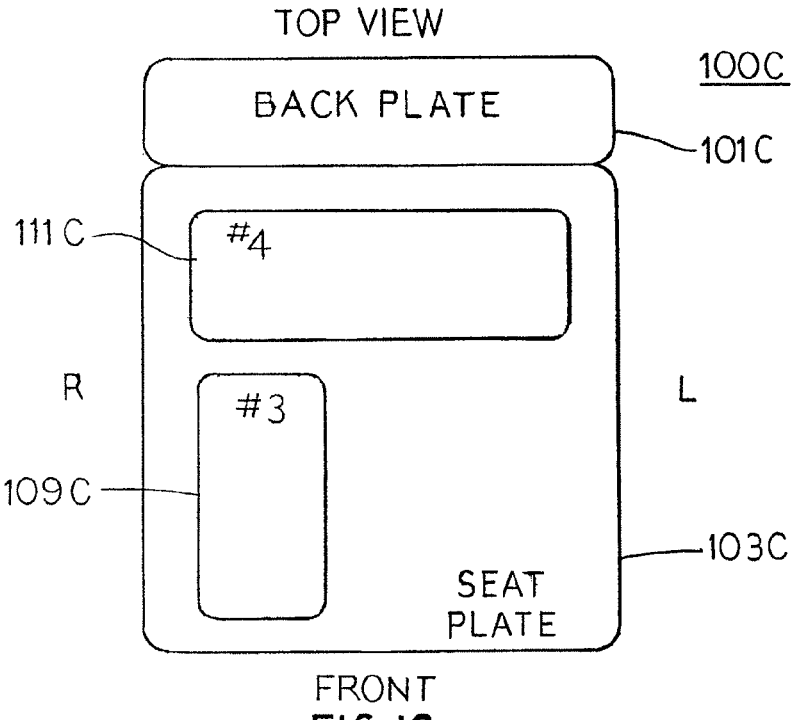
FIG.IC

HIP BURSITIS/TENDINITIS (DEGENERATIVE DISC/JOINT DISEASE)

INFLATION AND DEFLATION OF AN ENCASED BLADDER SYSTEM

FIELD OF THE INVENTION

The present invention relates generally to the field of a seating apparatus with an encased bladder system. In particular, the seating apparatus may reduce an effect of an ailment for a user by inflating and deflating the encased bladders.

BACKGROUND OF THE INVENTION

Individuals are exposed to increasingly static (e.g., sedentary) activities, in working, commuting and recreational environments. For example, workers are often tied to a computer during a major portion of a workday, typing at a keyboard and watching a computer display. Also, people are traveling throughout the world, cramped many hours in an airplane seat, or commuting to work, often sitting for hours in bumper-to-bumper traffic. The sedentary nature of these activities often causes constant static pressures on different parts of a person's body, depending on the type of sedentary activity and the seating accommodations. Consequently, an individual may suffer from different maladies such as sciatica and degenerative disc diseases.

In addition to the increased sedentary nature of working and recreational environments, people are living longer. Living in one's 80's or 90's is no longer the exception but the norm. With the extension of one's lifespan, one often suffers from arthritic and vertebral conditions. Such conditions may exacerbate maladies resulting from sedentary activities.

Consequently, there is a need to treat different ailments associated with static environments.

SUMMARY OF THE INVENTION

The present invention provides seating apparatuses that may reduce an effect of an ailment such as sciatica or joint pain.

With one aspect of the invention, a seating apparatus includes a back portion and a seating portion, each portion having at least one encased bladder that is inflated by a pumping component in a timed sequence. The bladders may be asymmetrically situated with respect to a center axis. Bladders may be spatially overlapping and may remain inflated during the same time interval.

With another aspect of the invention, encased bladders are inflated and deflated in accordance with a predetermined time sequence and may be independently controlled. Bladders may remain inflated during the same time interval and may be deflated concurrently. A cycle of the predetermined time sequence may be repeated so that treatment is applied for a desired period of time.

With another aspect of the invention, bladders may have different shapes and sizes in accordance with the intended treatment. Furthermore, bladders may be tapered.

With another aspect of the invention, a remote control unit communicates with a pumping component in order to inflate and deflate encased bladders in a seating apparatus.

With another aspect of the invention, a seating apparatus may contain a set of encased bladders that may be configured for different ailments. A user may indicate a treatment for one of the ailments through a remote control unit so that a subset of bladders is configured. The selected subset of bladders is consequently inflated and deflated.

BRIEF DESCRIPTION OF THE DRAWINGS

The foregoing summary of the invention, as well as the following detailed description of exemplary embodiments of the invention, is better understood when read in conjunction with the accompanying drawings, which are included by way of example, and not by way of limitation with regard to the claimed invention.

FIGS. 1A-1C show an apparatus for treatment of sciatica in accordance with an embodiment of the invention;

DETAILED DESCRIPTION OF INVENTION

Figure 2:
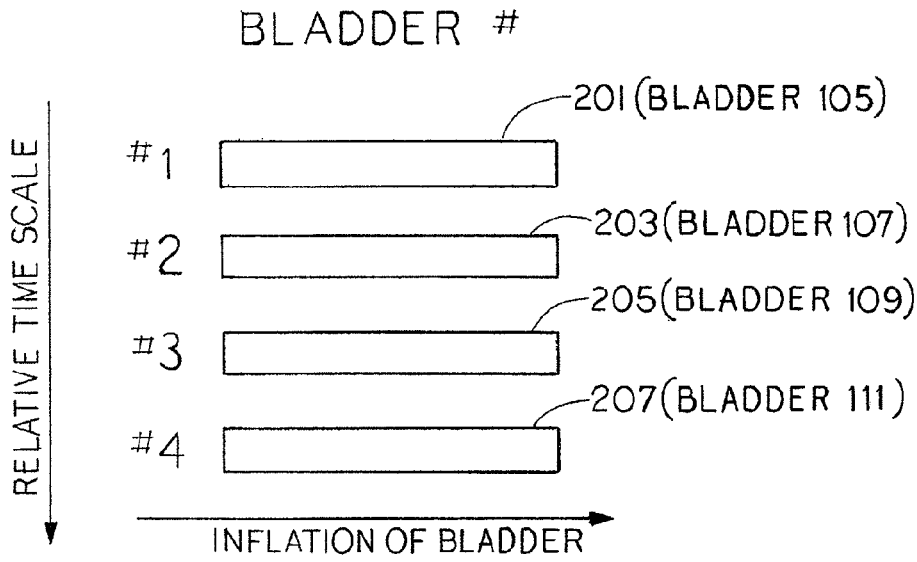
FIG. 2 shows a sequencing for inflating bladders in accordance with an embodiment of the invention.

FIGS. 1A-1C show a seating apparatus for treatment of sciatica in accordance with an embodiment of the invention. FIG. 1A shows front view 100*a* of the seating apparatus that includes back portion 101*a* and seat portion 103*a*. As shown in FIG. 1A, seat portion 103*a* has a seat plate, which prevents encased bladders (not shown but shown as bladders 109 and 111 in FIGS. 1B and 1C) from bulging away from a user. Thus, the encased bladders bulge only in the direction of the user. Back portion 101*a* also includes a back plate that similarly prevents bulging of encased bladders 105*a* and 107*a* in a direction away from the user. (Please note that the same entity may be shown in different views. Correspondingly, the same entity is labeled with the same number having different letter subscripts in the different views.)

As shown in FIG. 1A, back portion 101*a* contains bladder 105*a* and bladder 107*a* that are asymmetrically situated with respect to a center axis of back portion 101*a*. Bladders 105*a* and 107*b* are typically inflated and deflated in a desired sequence to relieve pressure on the user's body sciatic nerve due to a static body posture when the user is seated for prolonged periods of time.

FIG. 1B shows side view 100*b* of the seating apparatus. Back portion 101*b*, seat portion 103*b*, bladder 105*b*, and bladder 107*b* correspond to back portion 101*a*, seat portion 103*a*, bladder 105*a*, and bladder 107*a*, respectively, as shown in front view 100*a*. In addition, 100*b* shows bladder 109*b* and bladder 111*b* that are encased in seat portion 103*b*.

FIG. 1C shows top view 100*c* of the seating apparatus. Back portion 101*c*, seat portion 103*c*, bladder 109*c*, and bladder 111*c* correspond to back portion 101*a*/101*b*, 103*a*/103*b*, bladder 109*b*, and bladder 111*b*, respectively. Bladders 105 and 107 (not shown) are encased in back portion 101*c*.

A seating apparatus, e.g., the seating apparatus shown in FIGS. 1A-1C operate with independent bladders that may be controlled electronically or manually to inflate and deflate the bladders sequentially. Each bladder may be uniquely shaped in order to inflate into various shapes, e.g., oval, rectangular, and wedge shapes as viewed from a side profile. A seating apparatus may be manufactured in various sizes and shapes to fit different vehicle seats and to accommodate different body sizes. A seating apparatus may be further integrated into a design of chair, car, train, or airplane seats or may be operated as a portable device and placed in a variety of chair designs used for car, train, airplane, home, and office environments.

A seating apparatus may be powered by a range of electrical systems, e.g., 12 volts (corresponding to an automobile electrical system, 110/120 volts (corresponding to North American electrical systems), and 220/240 volts (corresponding to European, Australian, and New Zealand electrical systems) according to the required application. In particular, a seating apparatus having one or more pumps and valves may be powered by an electrical system to inflate and deflate the encased bladders.

In an embodiment of the invention, inflation and deflation of the encased bladders (e.g., bladders 105-111) are designed to relieve pressure on the sciatic nerve resulting from static body posture when the user is seated for prolonged periods of time. The motion created by the pelvic region by systematic inflation and deflation of the encased bladders typically reduces the constant static pressure on the user's sciatic nerve. Consequently, leg pain, leg aches, and leg numbness may be reduced, minimized, or even eliminated. While the embodiment shown in FIGS. 1A-1C is directed to the treatment of sciatica, other embodiments may be directed to other ailment types as will be exemplified in FIGS. 5A-5B, 6A-6C, and 7A-7C.

A seating apparatus may be operated by wired or wireless remote control. As will be discussed, the remote control may provide automatic sequencing to inflate and deflate the encased bladders. Each bladder fully or partially inflates in a predetermined sequence for a preprogrammed time. At times, only an individual bladder may be inflated. At other times, two or more bladders may be inflated. Alternatively, the encased bladders may be inflated and deflated manually to control each bladder independently.

FIG. 2 shows a time sequence for inflating bladders 105, 107, 109, and 111 (as shown in FIGS. 1A-1C) in accordance with an embodiment of the invention. Inflation 201, 203, 205, and 207 correspond to inflating bladders 105, 107, 109, and 111, respectively. In an embodiment, one pump inflates one bladder at a selected time interval. While the vertical direction represents time, the time is not scaled but is relative in showing the sequencing of inflating the bladders. As shown in FIG. 2, bladder 105, bladder 107, bladder 109, and bladder 111 are inflated in that order. Some of bladders 105, 107, 109, and 111 may remain inflated during overlapping time intervals.

Figure 3:
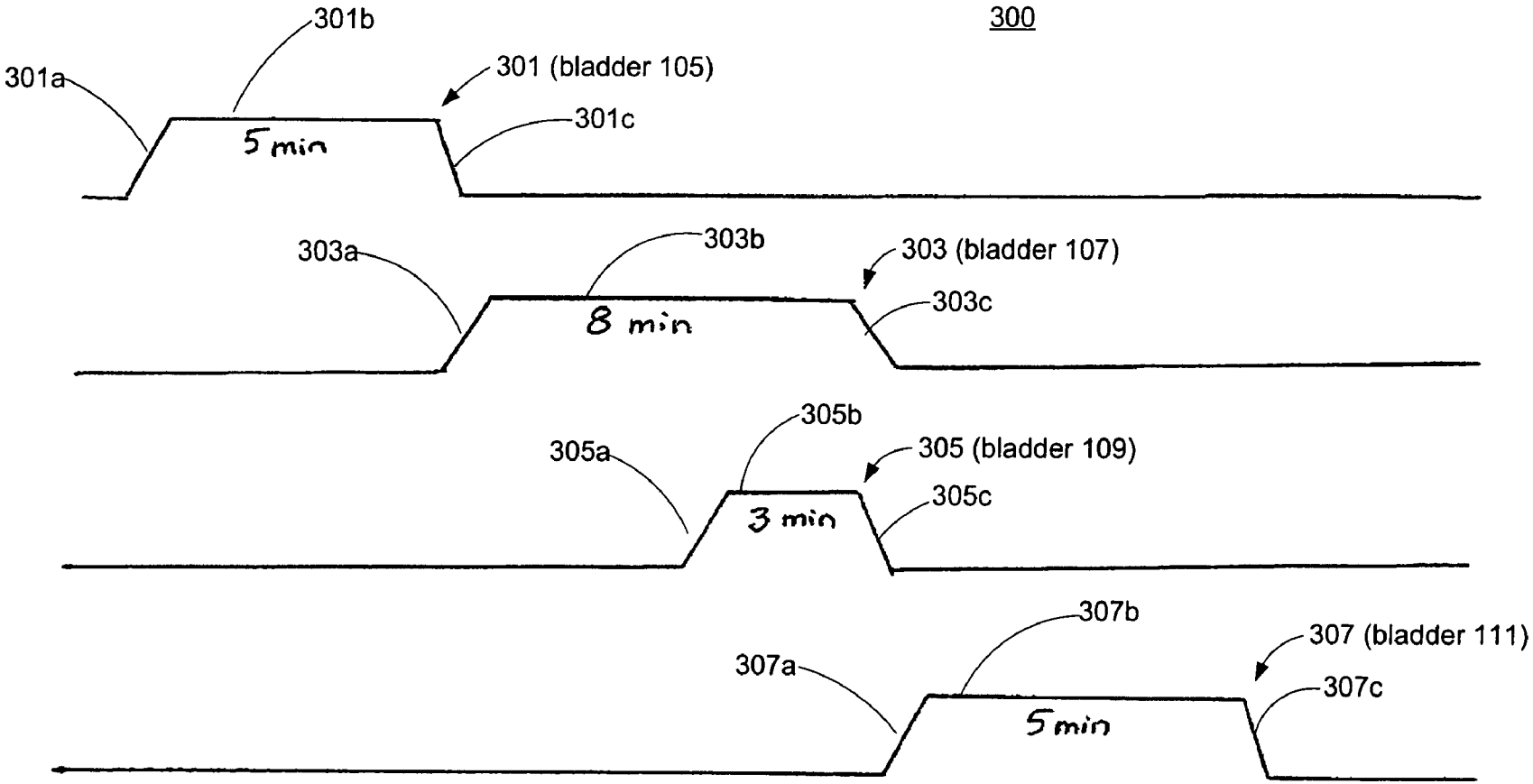
FIG. 3 shows a timing diagram for inflating and deflating bladders in accordance with an embodiment of the invention.

FIG. 3 shows timing diagram 300 for inflating and deflating bladders in accordance with an embodiment of the invention. Waveforms 101, 103, 105, and 107 correspond to time sequences for inflating/deflating bladders 105, 107, 109, 111, respectively. (While not explicitly shown in FIG. 3, bladders 105, 107, 109, and 111 may be inflated to different pressures in order to appropriately affect different points of the user's body.) Bladder 105 inflates to a required level of inflation during time duration 301*a* (approximately 10 seconds) and maintains inflation during time duration 301*b* (approximately 5 minutes). Bladder 105 then deflates during time duration 301*c* (approximately 8 seconds). (In timing diagram 300, the inflation and deflation time durations are not drawn according to scale and have been enlarged for illustrative purposes.) Bladder 107 inflates at the end of 301*c* to a required level of inflation during time duration 303*a* (approximately 10 seconds) and maintains inflation during time duration 303*b* (approximately 8 minutes), and then deflates during time duration 303*c* (approximately 8 seconds). Bladder 109 inflates at the $5^{th}$ minute of 303*b*'s phase to a required level of inflation during time duration 305*a* (approximately 10 seconds), maintains inflation during time duration 305*b* (approximately 3 minutes), and then deflates during time duration 305*c* (approximately 8 seconds), which is essentially simultaneous with 303*c*. Bladder 111 inflates to a required level of inflation during time duration 307*a* (approximately 10 seconds), maintains inflation during time duration 307*b* (approximately 5 minutes), and then deflates during time duration 307*c* (approximately 8 seconds). The above sequencing completes one complete cycle. The cycle may be repeated or the treatment may be terminated.

Figures 5A, 5B:
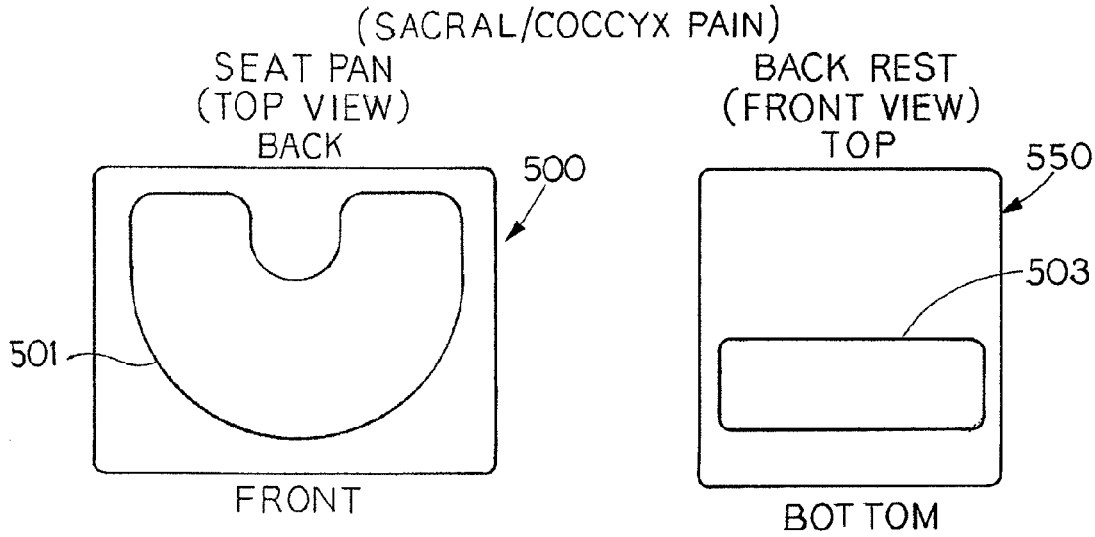
FIGS. 5A-5B show an apparatus for treating sacral/coccyx pain in accordance with an embodiment of the invention.
Figure 4:
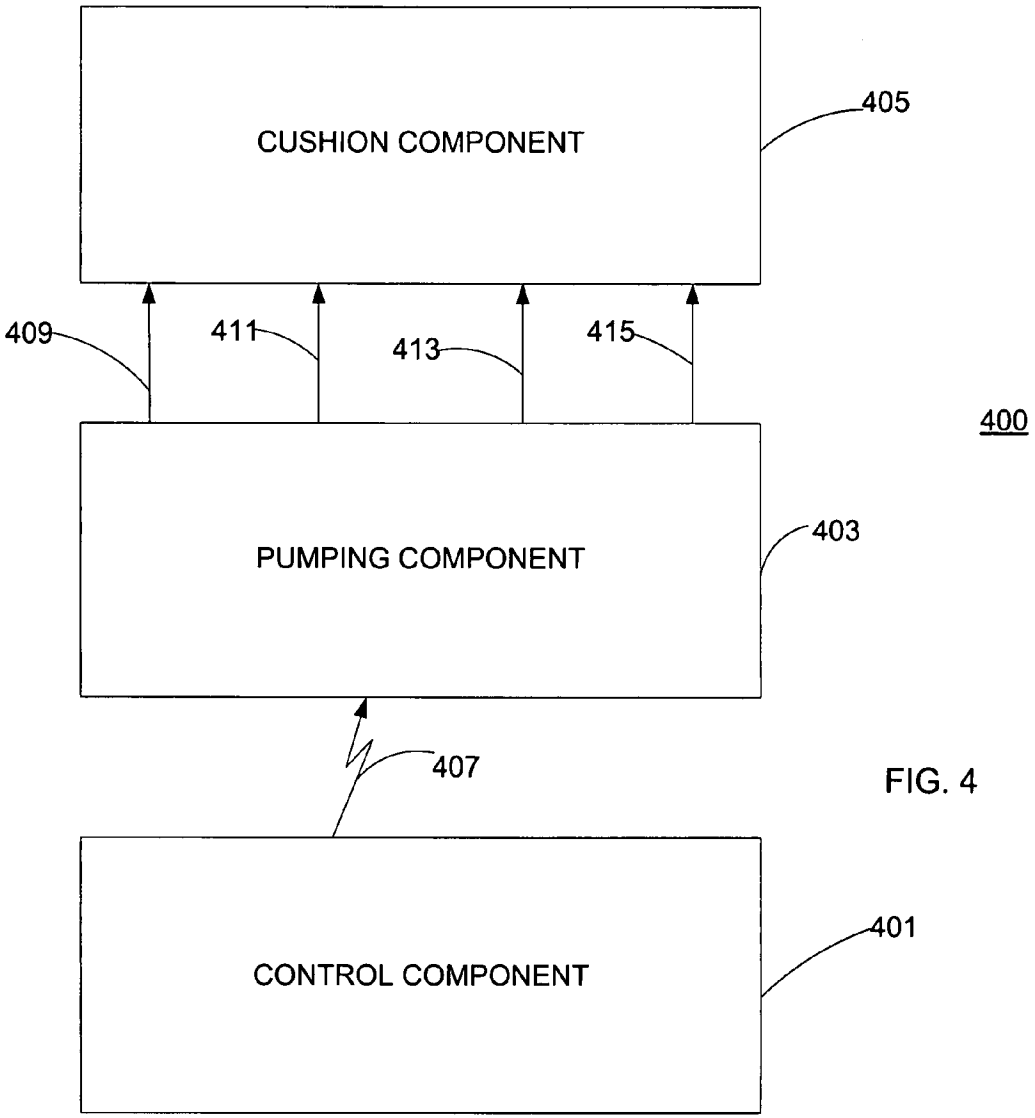
FIG. 4 shows an architecture for an apparatus that reduces an effect of an ailment.
Figure 6A:
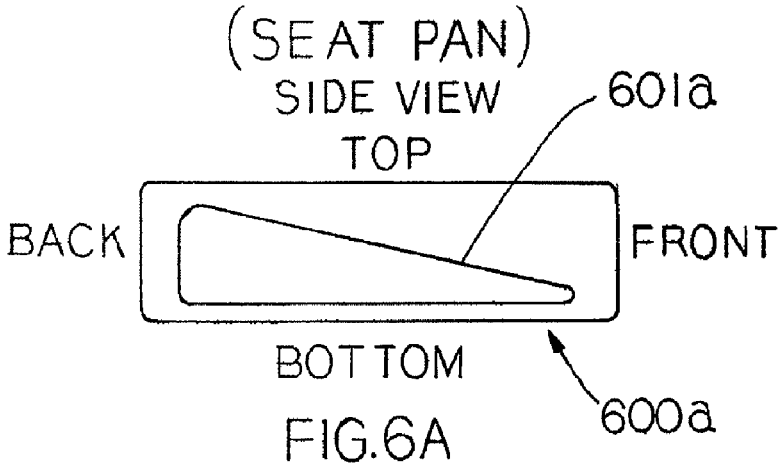
FIGS. 6A-6C show an apparatus for treating hip bursitis or tendonitis in accordance with an embodiment of the invention.
Figure 6B:
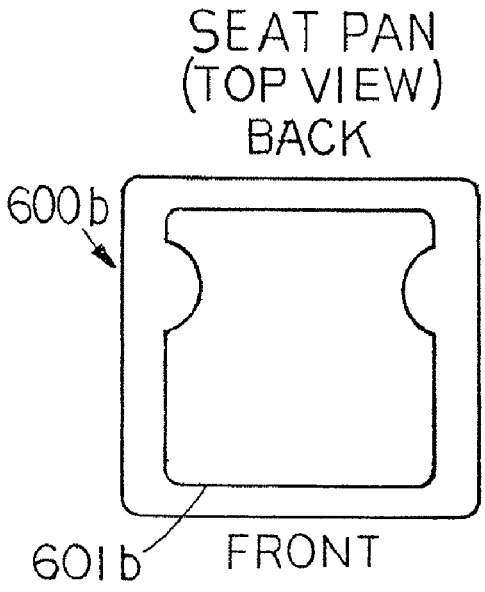
Figure 6C:
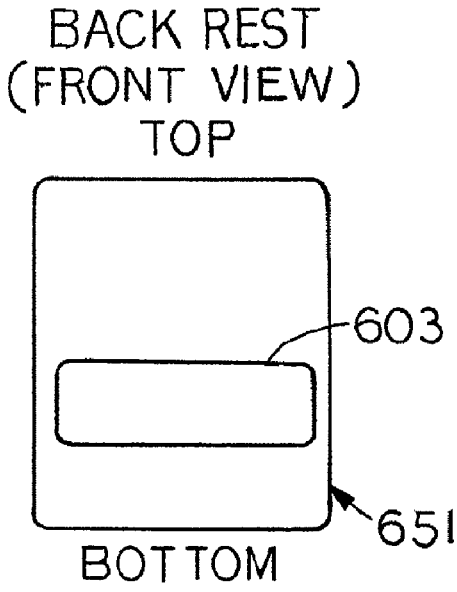
Figure 7A:
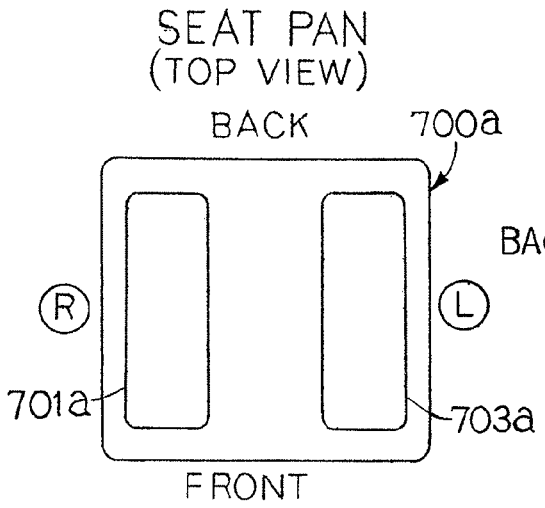
FIGS. 7A-7C show an apparatus for treating a degenerative disc or joint disease in accordance with an embodiment of the invention.
Figure 7B:
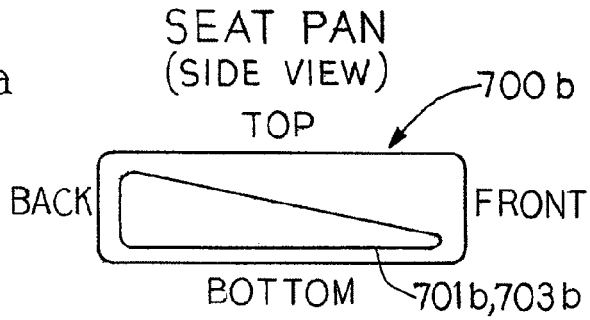
Figure 7C:
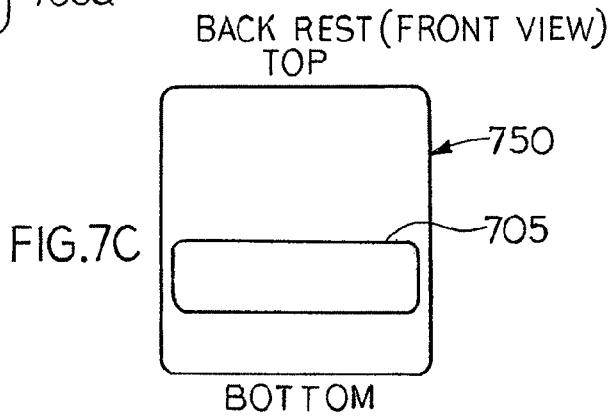

FIG. 4 shows an architecture for an apparatus 400 that reduces an effect of an ailment. Apparatus 400 may support the treatment of sciatica, as shown in FIGS. 1A-1C, or may support other types of aliments, e.g., sacral/coccyx pain (as shown in FIGS. 5A-5B), hip bursitis/tendinitis (as shown in FIGS. 6A-6C), and degenerative disc/joint disease (as shown in FIGS. 7A-7C). Moreover, embodiments of the invention may support the treatment of a plurality of ailment types by combining the bladders that are direct to different ailment types. For example, bladders 105, 107, 109, 111 (as discussed with FIGS. 1A-1C), 501 and 503 (as will be discussed with FIGS. 5A-5B), 601 and 603 (as shown in FIGS. 6A-6C), and 701, 703, and 705 (as shown in FIG. 7A-7C) may be encased in a seating apparatus. In order to treat a particular ailment, a subset of bladders is activated to treat the selected aliment type.

Apparatus 400 includes control component 401, pumping component 403, and cushion component 405. Cushion component 405 typically includes a back portion, seat portion, and associated encased bladders (e.g., as shown in FIGS. 1A-1C). The encased bladders are inflated by a pump contained in pumping component 403 through tubes 409, 411, 413, and 415. The pump directs compressed air to the appropriate bladder through a valve combination (not shown). Additionally, the valve combination also supports air release capability to deflate the appropriate bladder.

In an embodiment of the invention, control component 401 communicates with pumping component 403 over of communications channel 407 (e.g., a wired channel or a wireless channel) to configure a subset of bladders in response to a selection of the ailment type e.g., sciatica or a joint disease) by the user. In order to facilitate entry by the user, control component 401 may support a portable control panel having a portable keyboard through which the user selects an ailment that cushion component 505 will provide treatment to the user. Additionally, the user may indicate a time interval during which treatment is provided. Consequently, a treatment cycle (e.g., the cycle shown in FIG. 3) may be repeated for a time interval.

FIGS. 5A-5B shows an apparatus for treating sacral/coccyx pain in accordance with an embodiment of the invention. The apparatus includes seat portion (seat pan) 500 and back portion (back rest) 550. Bladder 501 is encased in back portion 500, and bladder 503 is encased in back portion 550. As previously discussed, bladders may be uniquely shaped in order to inflate into various shapes. For example, as illustrated in FIG. 5A, bladder 501 inflates into a U-shaped bladder (as viewed from above), while bladder 503 inflates into a rectangular-shaped bladder (as viewed frontally).

FIGS. 6A-6C shows an apparatus for treating hip bursitis or tendinitis in accordance with an embodiment of the invention. The apparatus includes seat portion 600*a*, 600*b* and back portion 651. Bladder 601*a*, 601*b* is encased in seat portion 600*a*, 600*b*, and bladder 603 is encased in back portion 651. Bladder 601*b* has a top view shape as shown in FIG. 6B. Furthermore, FIG. 6A illustrates that bladder 601*b* has a tapered shape when viewed from the side of the seat portion.

FIGS. 7A-7C show an apparatus for treating degenerative disc/joint disease in accordance with an embodiment of the invention. The apparatus includes seat portion (seat pan) 700*a*, 700*b* and back portion (back rest) 750. As shown in FIG. 7A, seat portion 700*a* includes bladders 701*a* and 703*a*, each bladder having a wedge shape as shown as 701*b*, 703*b* in side view 700*b*. As shown in FIG. 7C, bladder 705, which is rectangular-shaped, is encased in back portion 750.

Figure 8A:
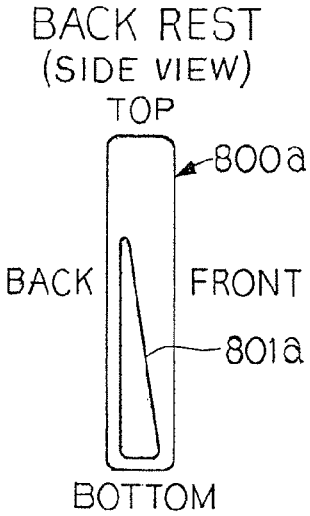
FIGS. 8A-8B show a bladder having a wedge shape in accordance with an embodiment of the invention.
Figure 8B:
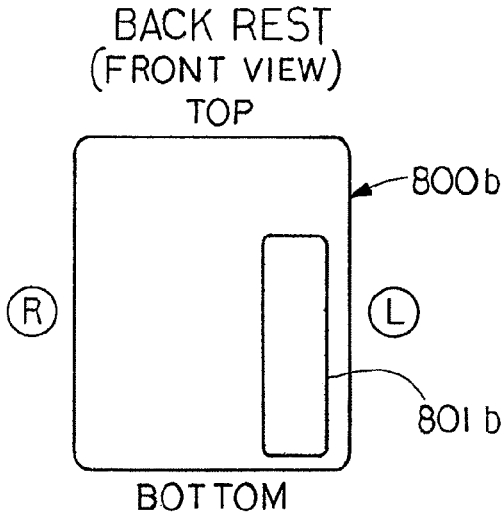

FIGS. 8A-8B further show a bladder 801*a*, 801*b* having a wedge shape in accordance with an embodiment of the invention. Bladder 801*a*, 801*b* is encased in back portion 800*a*, 800*b*. As shown in FIGS. 6A and 7B, a bladder having a wedge shape may also be encased in a seat portion.

Figure 9:
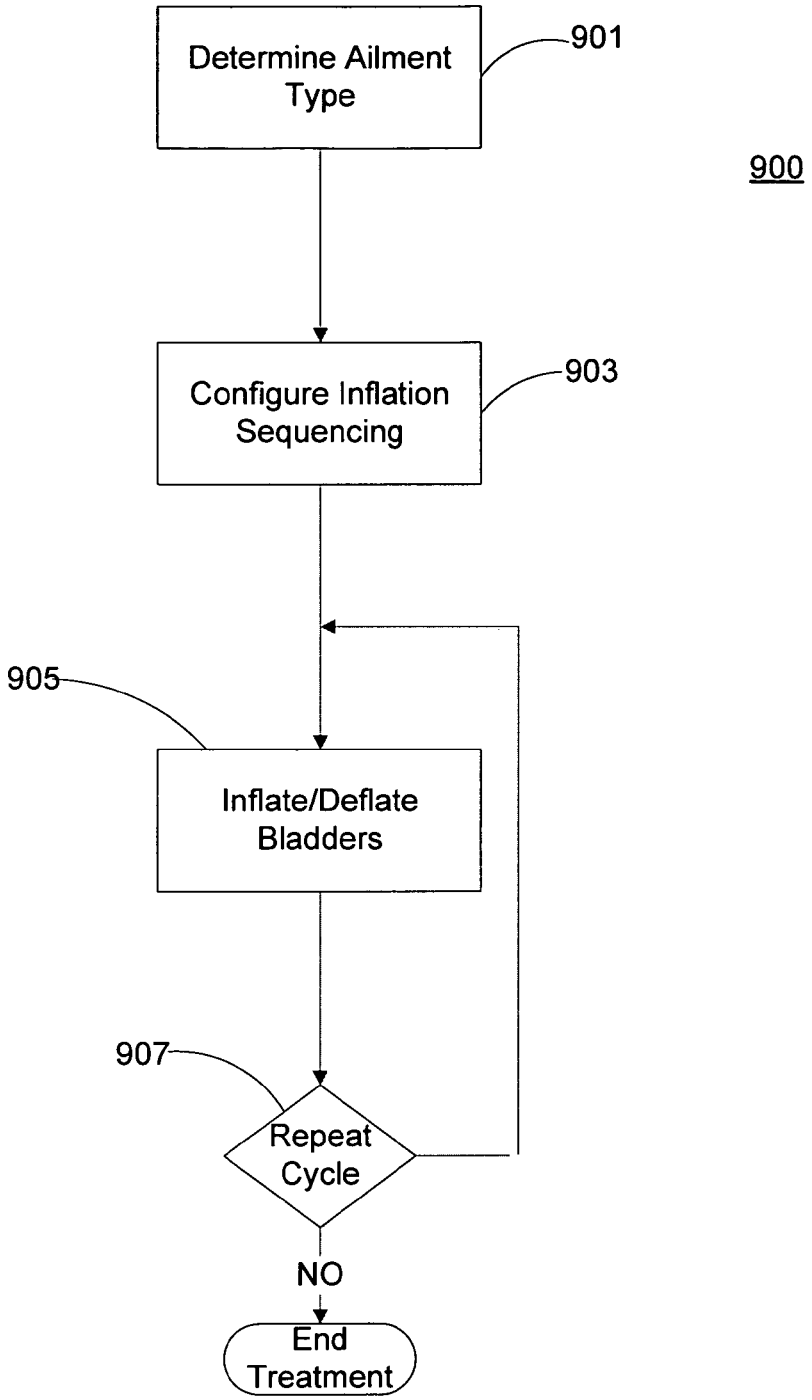
FIG. 9 shows a flow diagram for controlling an apparatus in treating an ailment in accordance with an embodiment of the invention.

FIG. 9 shows flow diagram 900 for controlling an apparatus (e.g., apparatus 400) in treating an ailment in accordance with an embodiment of the invention. A user may select an aliment type (e.g., hip bursitis) through control component 401 in step 901. Consequently, a corresponding subset of bladders is selected for sequenced inflation in step 903. In the embodiment, the bladders are inflated and deflated in accordance with a predetermined timing diagram (e.g., timing diagram 300) in step 905. Other embodiments may support a user to manually inflate and deflate the bladders. In step 907, the inflation and deflation of the bladders may be repeatedly cycled until instructed to end the treatment.

As can be appreciated by one skilled in the art, a computer system with an associated computer-readable medium containing instructions for controlling the computer system can be utilized to implement the exemplary embodiments that are disclosed herein. The computer system may include at least one computer such as a microprocessor, digital signal processor, and associated peripheral electronic circuitry.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A seating apparatus for reducing an associated effect for one of a plurality of ailments, the seating apparatus comprising:

a cushion component having a set of bladders within at least a portion of the cushion component, the cushion component having a back portion and a seating portion;

a pumping component inflating a selected subset of the set of bladders; and a control component configuring the selected subset of bladders in response to a selection of an ailment type, and communicating with the pumping component.

2. The apparatus of claim 1, the control component instructing the pumping component to inflate the selected subset to inflate with an associated sequence.

3. The seating apparatus of claim 2, the control component selecting a different subset of the set of bladders based on another of the plurality of ailments.

4. The seating apparatus of claim 3, the control component instructing the pumping component to inflate the different subset with a different sequence.

5. The seating apparatus of claim 2, the control component instructing the pumping component to inflate the selected subset to inflate with a different sequence.

6. The seating apparatus of claim 1, wherein the pumping component fully inflates at least two bladders at a same time.

* * * * *